US007654004B2

(12) United States Patent
Tsuda

(10) Patent No.: US 7,654,004 B2
(45) Date of Patent: Feb. 2, 2010

(54) HAND TOOL HAVING FIXED AND ROTATABLE IMPLEMENTS AND AN ASSOCIATED LOCKING MECHANISM

(75) Inventor: Hollan Akio Tsuda, Portland, OR (US)

(73) Assignee: Leatherman Tool Group, Inc., Portland, OR (US)

( * ) Notice: Subject to any disclaimer, the term of this patent is extended or adjusted under 35 U.S.C. 154(b) by 129 days.

(21) Appl. No.: 11/410,439

(22) Filed: Apr. 25, 2006

(65) Prior Publication Data

US 2007/0245570 A1 Oct. 25, 2007

(51) Int. Cl.
*B26B 1/04* (2006.01)

(52) U.S. Cl. ..... 30/152; 30/155; 30/160; 30/161

(58) Field of Classification Search ..... 30/160, 30/161, 339, 517, 151–156, 321, 330, 519
See application file for complete search history.

(56) References Cited

U.S. PATENT DOCUMENTS

| | | | | |
|---|---|---|---|---|
| 234,731 | A | 11/1880 | Slayton | |
| 338,251 | A | 3/1886 | Crandall et al. | |
| 404,870 | A | 6/1889 | Schenck | |
| 861,789 | A | 7/1907 | Zimmer | |
| 2,343,175 | A | 2/1944 | Evinger | |
| 3,600,735 | A * | 8/1971 | Jerabek | 15/49.1 |
| 3,942,249 | A * | 3/1976 | Poehlmann | 30/160 |
| 4,148,140 | A | 4/1979 | Lile | |
| 4,170,061 | A * | 10/1979 | Henry | 30/160 |
| 4,272,887 | A | 6/1981 | Poehlmann | |
| 4,404,748 | A | 9/1983 | Wiethoff | |
| 4,439,922 | A | 4/1984 | Sassano | |
| 4,442,559 | A | 4/1984 | Collins | |
| 4,524,518 | A | 6/1985 | West | |
| 4,541,175 | A | 9/1985 | Boyd et al. | |
| 4,604,803 | A | 8/1986 | Sawby | |
| 4,606,123 | A | 8/1986 | Wrench | |

(Continued)

FOREIGN PATENT DOCUMENTS

EP 1 570 959 B1 1/2008

OTHER PUBLICATIONS

*SOG Creators of Extraordinary Tools & Blades*, Seal—Revolver REV-7, 2 pages, Available at http://www.sogknives.com/revolver.html, visited Jan. 31, 2006.

(Continued)

*Primary Examiner*—Maurina Rachuba
(74) *Attorney, Agent, or Firm*—Alston & Bird LLP

(57) ABSTRACT

A hand tool is provided that includes both a fixed implement and a folding or rotatable implement, thereby taking advantage of the security and reliability of a fixed hand tool while also providing an additional implement in order to increase the utility of the resulting hand tool. In order to facilitate use of both fixed and rotatable implements, also provided are a locking mechanism, such as for individually locking the rotatable implement and the handle relative to the fixed implement, and a compound tool that can serve as the rotatable implement in order to mate with and receive at least a portion of the fixed implement, such as in instances in which both the fixed and rotatable implements are deployed.

30 Claims, 17 Drawing Sheets

U.S. PATENT DOCUMENTS

| | | | | | |
|---|---|---|---|---|---|
| 4,607,432 | A | | 8/1986 | Montgomery | |
| 4,651,419 | A | | 3/1987 | Reed, Jr. | |
| 4,750,267 | A | | 6/1988 | Boyd | |
| 4,805,303 | A | * | 2/1989 | Gibbs | 30/161 |
| 4,901,439 | A | | 2/1990 | Boyd, Jr. | |
| 4,918,820 | A | | 4/1990 | Korb et al. | |
| D378,489 | S | | 3/1997 | Poehlmann | |
| 5,722,168 | A | * | 3/1998 | Huang | 30/161 |
| D411,429 | S | * | 6/1999 | Gringer | D8/95 |
| 5,964,035 | A | | 10/1999 | Poehlmann | |
| 5,966,816 | A | | 10/1999 | Roberson | |
| 6,212,779 | B1 | | 4/2001 | Mitchell | |
| 6,594,906 | B1 | | 7/2003 | Sakai et al. | |
| 6,643,935 | B1 | | 11/2003 | Lowe, Sr. et al. | |
| 6,802,094 | B2 | | 10/2004 | Seber et al. | |
| 7,000,323 | B1 | | 2/2006 | Hatcher et al. | |
| 7,020,969 | B2 | | 4/2006 | Roberson | |
| 2005/0223563 | A1 | | 10/2005 | VanHoy et al. | |
| 2006/0016080 | A1 | | 1/2006 | Frazer | |

OTHER PUBLICATIONS

*SOG Creators of Extraordinary Tools & Blades*, Hunter Revolver HREV-7, 2 pages, Available at http://www.sogknives.com/hrevolver.html, visited Jan. 31, 2006.

*SOG Creators of Extraordinary Tools & Blades*, Double Action Revolver REV-8, 2 pages, Available at http://www.sogknives.com/darevolver.html, visited Jan. 31, 2006.

* cited by examiner

HAND TOOL HAVING FIXED AND ROTATABLE IMPLEMENTS AND AN ASSOCIATED LOCKING MECHANISM

FIELD OF THE INVENTION

Embodiments of the present invention relate generally to hand tools and, more particularly, to hand tools having both fixed and rotatable implements as well as associated locking mechanisms.

BACKGROUND OF THE INVENTION

A variety of hand tools have been developed including hand tools having fixed implements and hand tools having folding implements. For example, hand held knives include knives having fixed blade designs and knives having folding blade designs. Both fixed and folding designs have advantages and disadvantages.

With respect to hand tools having folding implements, such as a folding pocket knife, the hand tool can include a number of different implements in a relatively compact package. For example, a pocket knife may include two or more blades that are carried inside a handle for storage and are capable of being selectively opened. In addition to knife blades, folding hand tools can include a variety of other implements, such as a screwdriver, an awl, a bottle opener, a can opener, a saw, a file, etc., in order to add to the versatility and utility of the tools.

Although folding hand tools provide multiple implements in a relatively compact form, folding hand tools generally require locking mechanisms to ensure that the implement that has been deployed is locked into position and will not fold up during use. While locking mechanisms are generally effective, some locking mechanisms have been known to fail, which would unfortunately allow a deployed implement to fold up during use, generally without much, if any, notice to the user. Similarly, a user may deploy, i.e., unfold, an implement, such a knife blade, but may fail to fully deploy the implement in such a manner that the lock is engaged. In this situation, a user who believes that the implement is locked in position may begin to utilize the implement which may thereafter fold up since the implement is not, in fact, locked in position. This inadvertent folding of the implement during use will at least delay the user in accomplishing the intended function since the user must again deploy the implement and resume its use.

Hand tools having fixed implements, such as a knife having a fixed knife blade, generally have a more secure feel to the user and do not pose any risk to the user of inadvertently folding up during use. However, fixed hand tools generally include only a single implement, such as a knife blade, extending outwardly from the handle. In some designs, fixed hand tools have been developed that include a pair of blades or tools formed on opposite ends of the same implement. In these designs, the handle is generally secured to the member in such a manner that one blade or tool extends outwardly from the handle, while the other blade or tool is disposed within the handle. For example, the implement may be rotatably mounted to the handle such that in a first position, a first blade or tool extends outwardly from the handle while a second blade or tool is disposed within the handle. Conversely, in a second position, the second blade or tool extends outwardly from the handle while the first blade or tool is disposed within the handle.

In any event, a fixed hand tool generally includes only one or a very limited number of blades or tools, thereby restricting the use that can be made of the fixed hand tool. If a user of a fixed hand tool needs additional implements, the user must carry an additional tool, separate and apart from the fixed hand tool. In some circumstances, it is at least inconvenient to carry these additional tools. For example, fixed knives are widely utilized by outdoor enthusiasts, such as hunters and fishermen. In addition to a knife blade, however, a hunter typically desires a saw and/or a gut hook and must therefore separately carry these tools with them. As will be apparent, these additional tools add to the equipment that a hunter must remember to pack and must thereafter carry during the hunt.

As such, it would be desirable to provide a fixed hand tool that includes additional implements in order to enjoy the advantages of a fixed hand tool, while also increasing the utility of such a hand tool and decreasing the additional tools that must be separately carried by a user of the fixed hand tool.

BRIEF SUMMARY OF THE INVENTION

According to one embodiment, a hand tool is provided that includes both a fixed implement and a folding or rotatable implement, thereby taking advantage of the security and reliability of a fixed hand tool while also providing an additional implement in order to increase the utility of the resulting hand tool. In order to facilitate use of both fixed and rotatable implements, other aspects of the present invention are directed to an improved locking mechanism, such as for individually locking the rotatable implement and the handle relative to the fixed implement, and a compound tool that can serve as the rotatable implement in order to mate with and receive at least a portion of the fixed implement, such as in instances in which both the fixed and rotatable implements are deployed.

According to one aspect of the present invention, a hand tool is provided that includes a handle, a first implement extending outwardly from the handle and a second implement configured to rotate relative to the handle between a deployed position and a closed position. The hand tool of this aspect of the present invention may include a locking mechanism having first, second and third positions. In the first position, the locking mechanism may lock the handle and the first and second implements to thereby prevent relative rotation therebetween. In the second position, the locking mechanism permits relative rotation between the second implement and the handle while preventing relative rotation between the first implement and the handle. Finally, in the third position, the locking mechanism permits relative rotation between the handle and the first implement and, optionally, relative rotation between the second implement and the handle.

In one embodiment, the first implement includes a knife blade having a cutting edge. The first implement including the knife blade may be constructed as a fixed implement so as to extend from a first end proximate the knife blade to an opposed tang that is disposed within the handle while the locking mechanism is in the first and second positions. As the locking mechanism permits relative rotation between the handle and the first implement while in the third position, the first implement may also include a gut hook proximate the tang so as to increase the versatility of the hand tool. In one embodiment, the second implement may be a saw such that a single hand tool provides at least three different tools, such as a knife blade, a saw and a gut hook, with two of the tools being provided by a fixed implement.

In order to facilitate the deployment of the second implement while the first implement extends outwardly from the handle, one of the first and second implements may define a recess such that at least a portion of the other implement is disposed within the recess when the second implement has been deployed. For example, the second implement may define a recess such that at least a portion of the first implement is disposed within that recess when the second implement is in the deployed position. In the embodiment in which the first implement includes a knife blade, the cutting edge of the knife blade may be disposed within the recess defined by the second implement when the second implement is deployed. In this regard, the second implement may be a saw having a plurality of saw teeth extending along a first edge with the recess defined by the saw opening through a portion of the saw opposite the first edge.

According to another aspect of the present invention, a compound tool is provided that includes first and second cutting implements and a spacer positioned between the first and second cutting implements. Each cutting implement includes a respective cutting edge such that the spacer serves to space the cutting edge of the first cutting implement from the cutting edge of the second cutting implement. A recess may therefore be defined that opens between respective edges of the first and second cutting implements that are disposed opposite to the cutting edges. In this regard, the spacer may be disposed closer to the cutting edges of the first and second cutting implements than to the respective edges of the first and second cutting implements that are disposed opposite to the cutting edges in order to define the recess. As such, the compound tool of this aspect of the present invention may function as the implement of the hand tool described above which defines a recess for receiving a portion of the other implement when both implements are deployed.

In one embodiment, the first and second cutting implements are first and second saw blades, with each saw blade including a plurality of saw teeth along a respective cutting edge. As such, the spacer is positioned between the first and second saw blades to thereby space the plurality of saw teeth of the first saw blade from the plurality of saw teeth of the second saw blade.

According to yet another aspect of the present invention, a locking mechanism is provided. The locking mechanism includes a shaft defining a lengthwise extending axis and, in one embodiment, having a polygonal cross-sectional shape. The locking mechanism also includes a support surface extending at least partially about the shaft. The support surface includes first and second ramped surfaces that extend both at least partially about the shaft and axially along the shaft. In one embodiment, each of the first and second ramped surfaces extends no more than 90° about the shaft. Each ramped surface also has a terminal edge that is axially spaced from an adjacent portion of the support surface by first axial distance. The terminal edges of the first and second ramped surfaces may be positioned opposite to one another relative to the shaft.

The locking mechanism further includes first and second projections that extend laterally outward from the support surface. The first and second projections have a thickness in an axial direction that differs from the first axial distance by which the respective terminal edges of the first and second ramped surfaces are axially spaced from adjacent portions of a support surface. In one embodiment, for example, the thickness of the first and second projections is greater than the first axial distance. Additionally, the terminal edges of the first and second ramped surfaces may be proximate the first and second projections.

In one embodiment, the first and second projections are positioned symmetrically relative to a center of gravity of the locking mechanism. In this regard, each of the first and second projections may include a distal portion that extends between first and second corners. In this embodiment, an imaginary line extending from the first corner of the first projection to the second corner of the second projection extends through the center of gravity of the locking mechanism, while an imaginary line extending from the second corner of the first projection to the first corner of the second projection also extends through the center of gravity of a locking mechanism. As such, a locking mechanism having the first and second projections of this embodiment may experience reduced torsional stresses during actuation than non-symmetric designs.

The first and second implements are typically mounted upon the shaft of the locking mechanism. In the aspect of the present invention described above in which the locking mechanism has first, second and third positions, the second implement may define an opening that receives the first and second ramped surfaces while the locking mechanism is in the first position. However, the first and second ramped surfaces are displaced from the opening defined by the second implement. Still further, the handle may define an opening that receives the first and second projections while the locking mechanism is in the first and second positions. However, the first and second projections may be displaced from the opening defined by the handle while the locking mechanism is in the third position. Thus, movement of the locking mechanism from the first to the second position effectively releases the second implement, while movement of the locking mechanism to the third position effectively releases the handle such that each of the different tools can be individually accessed and utilized.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1A:
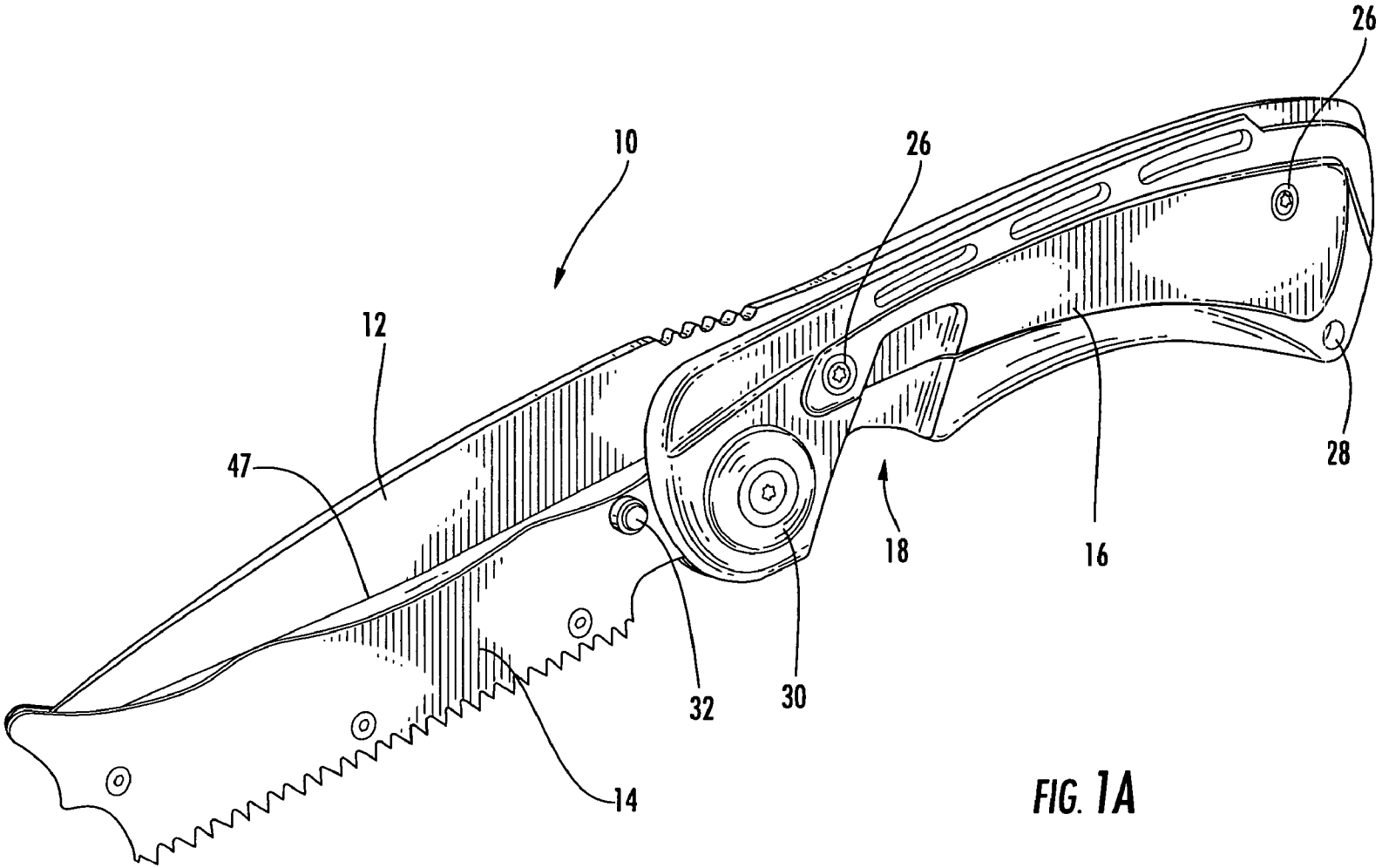
FIG. 1A is a perspective view of a hand tool according to one embodiment of the present invention in which the locking mechanism is in the first position.
Figure 1B:
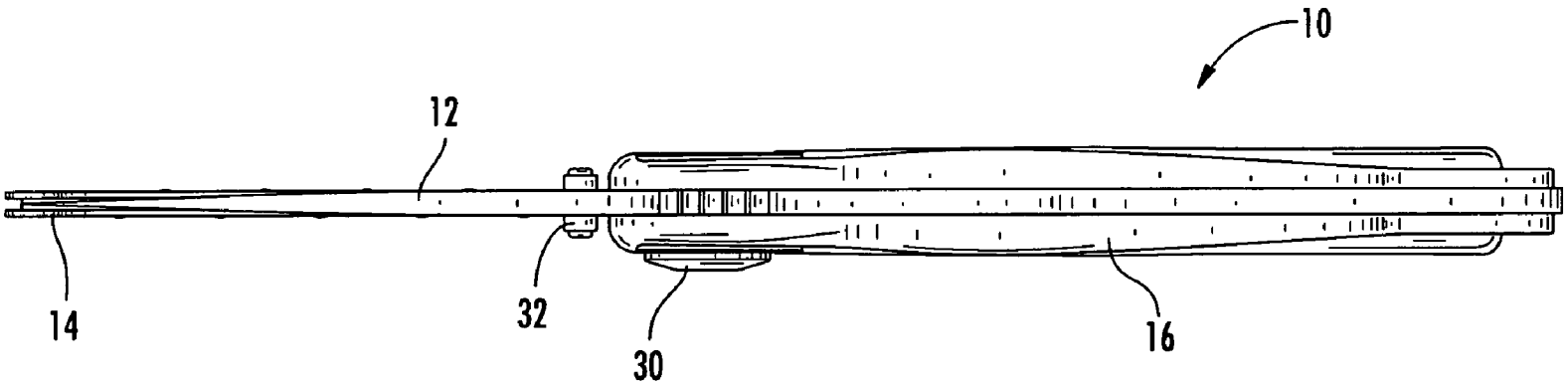
FIGS. 1B and 1C are views from opposite sides, e.g., top and bottom sides, of the hand tool of FIG. 1A.
Figure 1C:
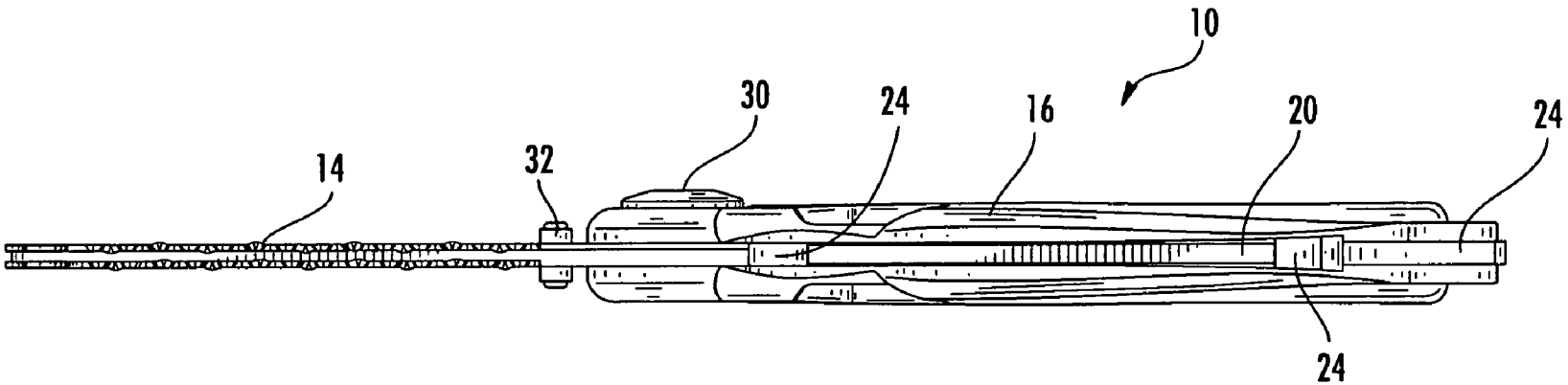

Referring now to FIGS. 1A, 1B and 1C, a hand tool 10 according to one embodiment is depicted. According to this embodiment, the hand tool combines a first, fixed implement 12 and a second, rotatable implement 14. For example, the fixed implement may include a knife blade, while the rotatable implement is a saw. However, the hand tool can include a wide variety of other blades or tools and should not be limited in any manner to those discussed in conjunction with the illustrated embodiments. For example, the implements may alternatively include various combinations of a sharpened knife blade, a serrated blade, a screw driver, and awl, a bottle opener, a can opener, a saw, a file or other type of blade or tool.

The hand tool 10 includes a handle 16 sized and shaped so as to be readily grasped by a user. In the illustrated embodiment, for example, the handle defines a notch 18 positioned to receive the index finger of the user as well as a smoothly curved portion extending generally rearwardly from the notch for permitting the other fingers of the user to wrap thereabout. Typically, the handle, as well as the fixed and rotatable implements 12 and 14, are comprised of a metallic material, but the handle may include wood or other inlays for decorative or aesthetic purposes, if desired.

In order to receive the rotatable implement 14 as well as a portion of the fixed implement 12, the handle 16 advantageously defines an internal cavity 20. See FIG. 1C. Advantageously, the internal cavity defined by the handle opens through both of the opposed major edges 20*a* of the handle to facilitate receipt of the rotatable second implement and a portion of the fixed implement as described below. While the handle may be formed as an integral component, the handle of the embodiment depicted in FIGS. 2 and 3 includes first and second handle portions 22 that are spaced apart by one or more spacers 24 that are disposed between and/or extend inwardly from one or both of the handle portions. Typically, the spacers are sized such that the width of the internal cavity between the handle portions is slightly greater than the width of the largest implement that will be stored therein such that the implements can be snugly received within the internal cavity. The handle of this embodiment also includes one or more connectors 26, such as rivets, screws, adhesive, fasteners or the like, for securely connecting the first and second handle portions. In this regard, the connectors can extend through respective spacers such that both handle portions are securely joined.

As shown, the spacers 24 may be positioned in a medial portion of the handle 16 so as to be spaced away from both major edges 20*a* of the handle. As such, not only does the internal cavity 20 defined by the handle open through both of the opposed major edges of the handle, but the portion of the internal cavity that is defined between the spacers and each major edge of the handle is sized to be sufficiently large so as to receive the rotatable implement 14 or a portion of the fixed implement 12. Depending upon the size and shape of the rotatable implement and the portion of the fixed implement to be housed within the internal cavity defined by the handle, the spacers can be repositioned to differently divide the internal cavity between that portions of the internal cavity proximate each major edge of the handle.

Figure 2:
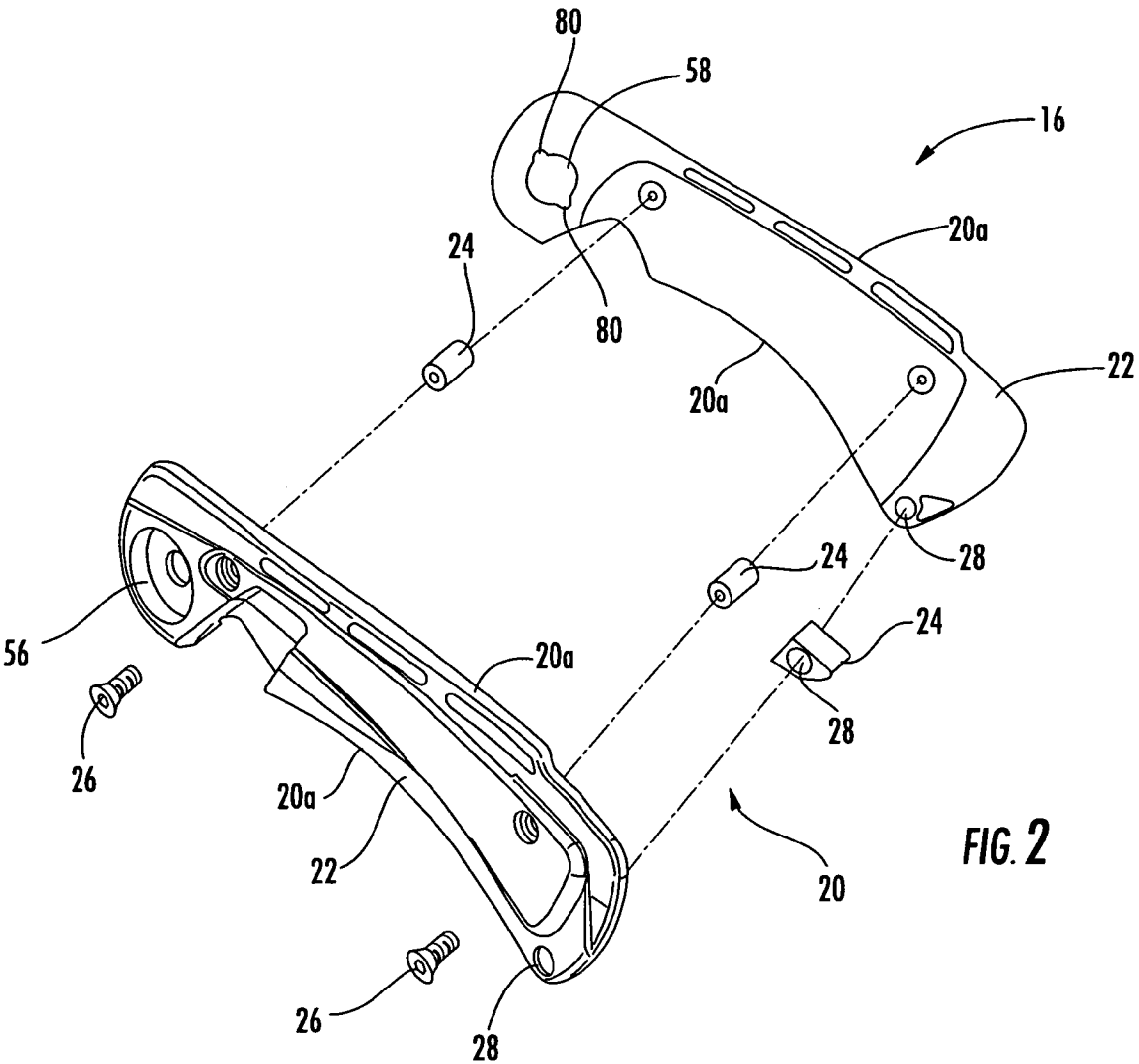
FIG. 2 is an exploded perspective view of a handle of a hand tool according to one embodiment of the present invention.
Figure 3:
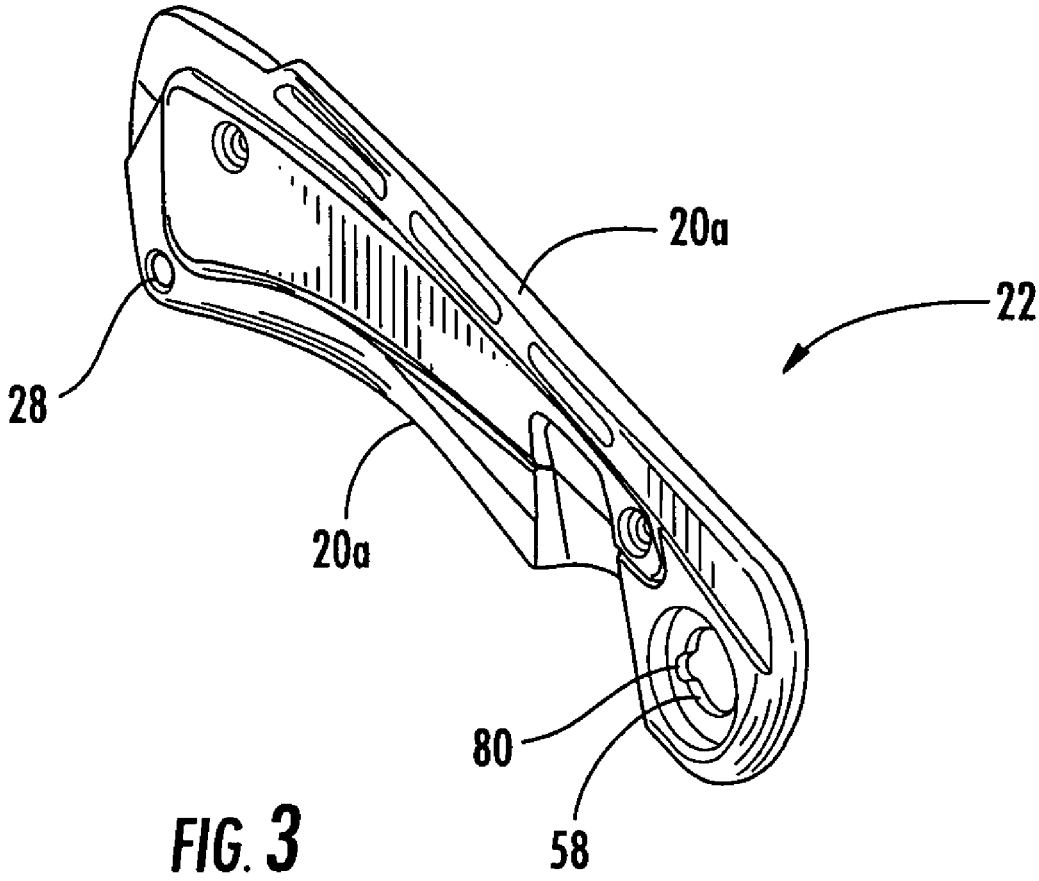
FIG. 3 is a perspective view of one of the handle portions of the handle of FIG. 2 depicting an exterior surface of the handle portion that is hidden from view in FIG. 2.

As shown in FIG. 2, a spacer 24 may optionally also be disposed proximate the rearwardmost portion of the handle 16 in order to add stability and strength to the handle. As shown, an aperture 28 can be defined through the handle, such as that portion of the handle that is supported by the rearwardmost spacer, such that the hand tool 10 can be connected to a lanyard or the like.

One or more of the spacers 24 may also be covered by a gasket or other shock absorbing material, such as rubber or the like. By covering the spacers with a shock absorbing material, the forces that would otherwise be generated as a result of contact by one of the implements with the spacer are reduced and any damage that might otherwise have been done to an implement as a result of its contact with the spacer is reduced or avoided altogether. Additionally, by covering the spacers with a shock absorbing material, any play engendered upon folding an implement into the handle is taken up or at least reduced.

The first and second implements 12, 14 of the hand tool 10 are connected to the handle 16 with the handle and the second implement adapted for rotation relative to each other and relative to the first implement. In this regard, the hand tool can include a locking mechanism 30 that engages the first and second implements and connects the first and second implements to the handle. As described below, the locking mechanism therefore defines the pivot point for the relative rotation between the first and second implements and the handle. The locking mechanism of the hand tool of one embodiment defines first, second and third positions.

In the first position shown in FIGS. 1A-1C, the locking mechanism 30 locks the handle 16 and the first and second implements 12, 14 to prevent relative rotation therebetween. In this regard, the first implement is locked in position relative to the handle such that a first portion of the implement extends outwardly from the handle while a second, opposed portion of the first implement is at least partially disposed within the internal cavity defined by the handle. In the illustrated embodiment in which the first implement includes a knife blade and an opposed gut hook, the locking mechanism locks the first implement in the first position such that the knife blade extends outwardly from the handle while the gut hook is disposed within the internal cavity defined by the handle. The hand tool of the illustrated embodiment also depicts the second implement to be a saw having a saw blade with a plurality of saw teeth disposed along a first edge. The saw also extends outwardly from the handle and is positioned proximate to the knife blade as described more fully below. Regardless of the particular tools provided by the first and second implements, the locking mechanism prevents relative rotation between the first and second implements and the handle while in the first position.

Figure 4:
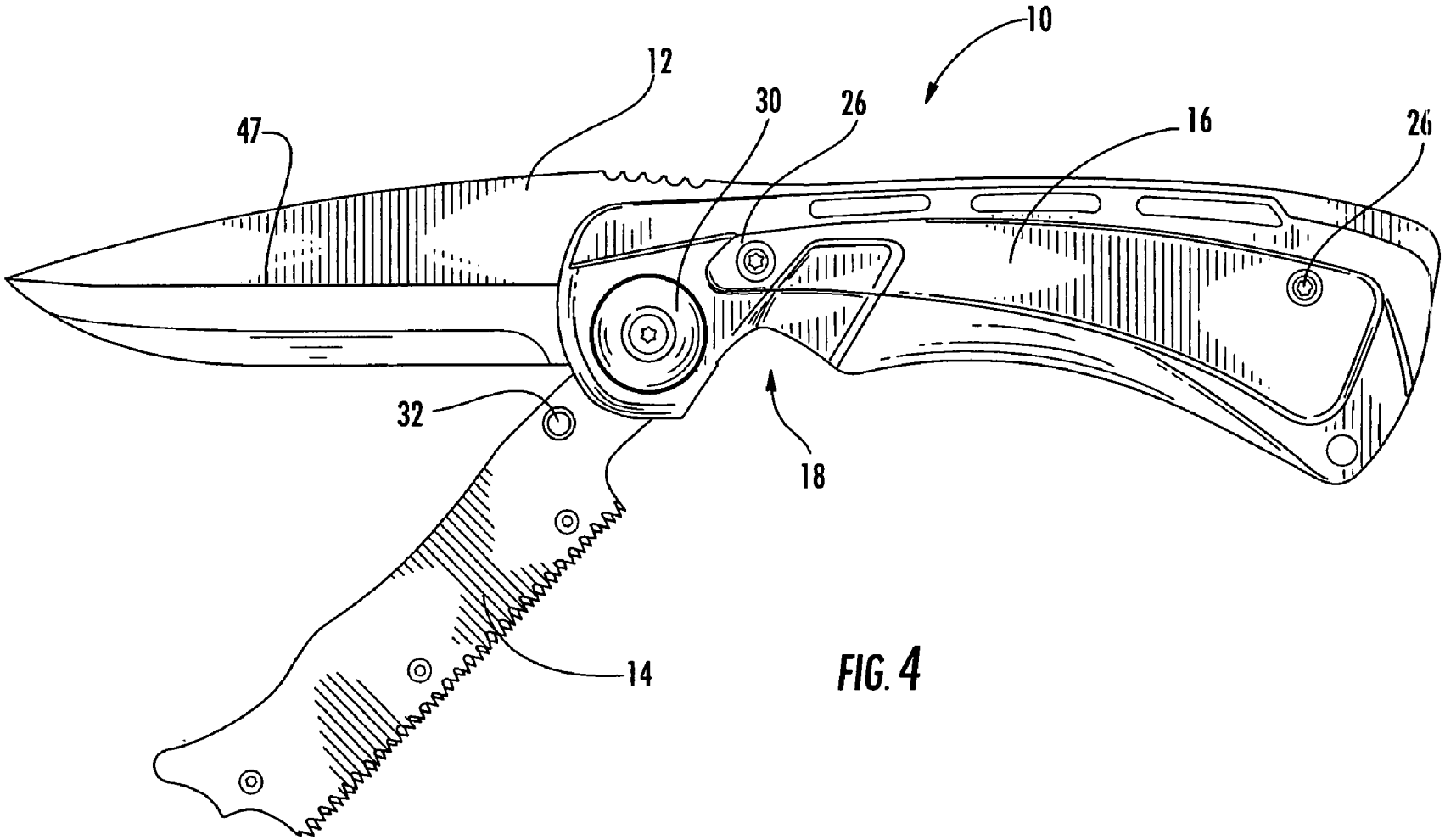
FIG. 4 is a perspective view of the hand tool of FIG. 1A in which the locking mechanism is in the second position and the rotatable implement is in an intermediate state of rotation.
Figure 5:
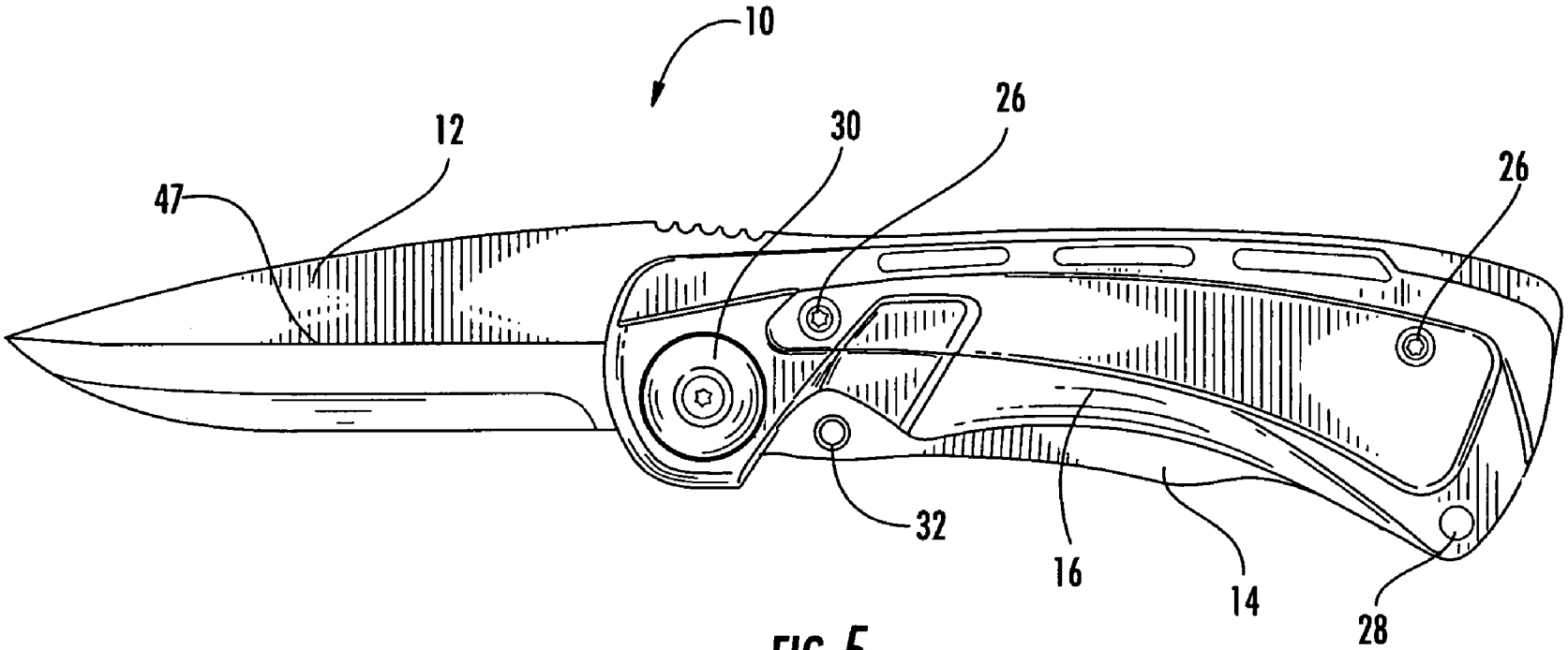
FIG. 5 is a perspective view of the hand tool of FIG. 1A in which the locking mechanism is in the second position and the rotatable implement has been fully rotated and at least partially disposed within the handle.

In the second position, the locking mechanism 30 permits relative rotation between the second implement 14 and the handle 16 while preventing relative rotation between the first implement 12 and the handle. As shown in FIGS. 4 and 5, for example, the locking mechanism in the second position permits the second implement to be rotated about the pivot point relative to the handle and relative to the first implement. In the illustrated embodiment, the locking mechanism permits the second implement to be rotated relative to the handle such that it least a portion of the second implement is received by and disposed within the internal cavity 20 defined by the handle. If desired, the locking mechanism can optionally be configured to lock the second implement in the folded position within the handle.

In embodiments in which the second implement 14 has a cutting edge, such as a plurality of saw teeth, the second implement may be rotated relative to the handle 16 such that at least the cutting edge is disposed within the internal cavity 20 defined by the handle. In the illustrated embodiment, the internal cavity defined by the handle and the second implement are correspondingly sized and shaped such that the majority of the second implement is disposed within internal cavity defined by the handle. In this regard, the internal cavity defined by the handle and the second implement may be sized such that the edge of the second implement that is opposite the cutting edge is proximate to and in general alignment with the edge 20*a* of the handle, thereby largely filling the opening and providing a more complete surface for the user to grip.

In the illustrated embodiment, it is noted that the only portion of the second implement 14 that remains exposed after being folded into the handle 16 is that portion of the second implement proximate the notch 18 defined by the handle. In this regard, the second implement can include a thumb stud 32 extending outwardly from one or both sides that is positioned within the notch defined by the handle. This thumb stud provides a feature for the user to engage in order to facilitate folding and unfolding of the second implement relative to the handle. Thus, the thumb stud generally remains exposed even once the second implement that has been folded into the handle.

Once the second, rotatable implement 14 has been folded into the handle 16 as permitted by the locking mechanism 30 in the second position, the portion of the first implement 12 that extends outwardly from the handle is fully exposed and can be employed by the user. For example, in the illustrated embodiment of FIG. 5, the portion of the first implement that extends outwardly from the handle includes a knife blade having a cutting edge. As noted above, the knife blade of the illustrated embodiment is a portion of a fixed implement that extends from the knife blade to an opposed tang that is disposed within the handle while the locking mechanism is in the first and second positions.

Figure 6:
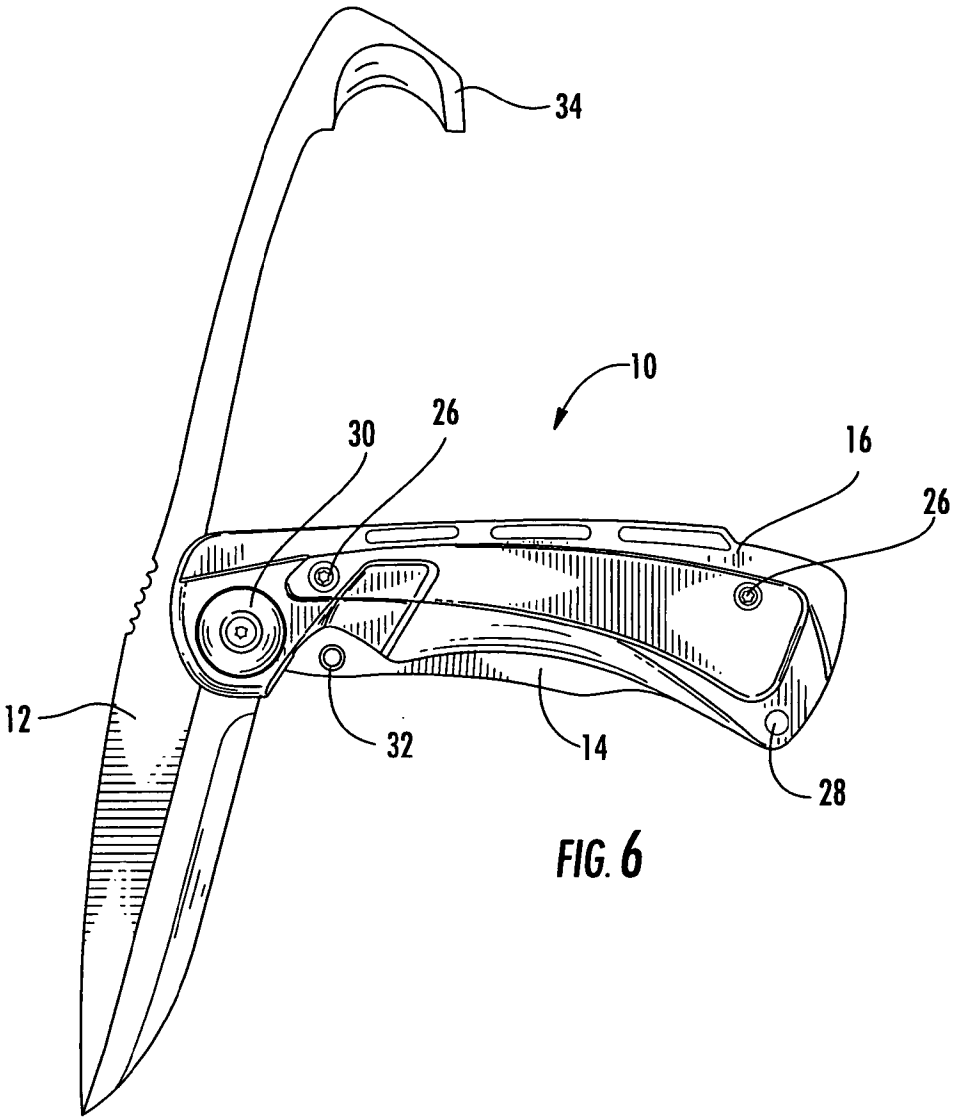
FIG. 6 is a perspective view of the hand tool of FIG. 1A in which the locking mechanism is in the third position and the handle is in an intermediate state of rotation.

In order to increase the utility of the hand tool 10, the locking mechanism 30 also defines a third position in which relative rotation is permitted between the handle 16 and the first implement 12. As shown in FIG. 6, the handle is capable of rotating relative to the first implement and, in most embodiments, the second implement 14 such that the portion of the first, fixed implement that was previously disposed within the handle is now exposed. By continuing the rotation of the handle relative to the first implement, the portion of the first, fixed implement that originally extended outwardly from the handle, e.g., the knife blade, is folded at least partially into the handle such that the opposite end of the fixed implement is now in an operative position. See FIG. 7. In this regard, the opposite end of the fixed implement may include a variety of different tools as noted above, such as the gut hook 34 shown in FIGS. 6 and 7. Once the handle has been fully rotated relative to the fixed implement, the locking mechanism may lock the handle and the fixed implement in position. Alternatively, the handle and the locking mechanism may be designed such that the fixed implement may remain unlocked even once the handle has been fully rotated relative to the fixed implement, if so desired.

Figure 7:
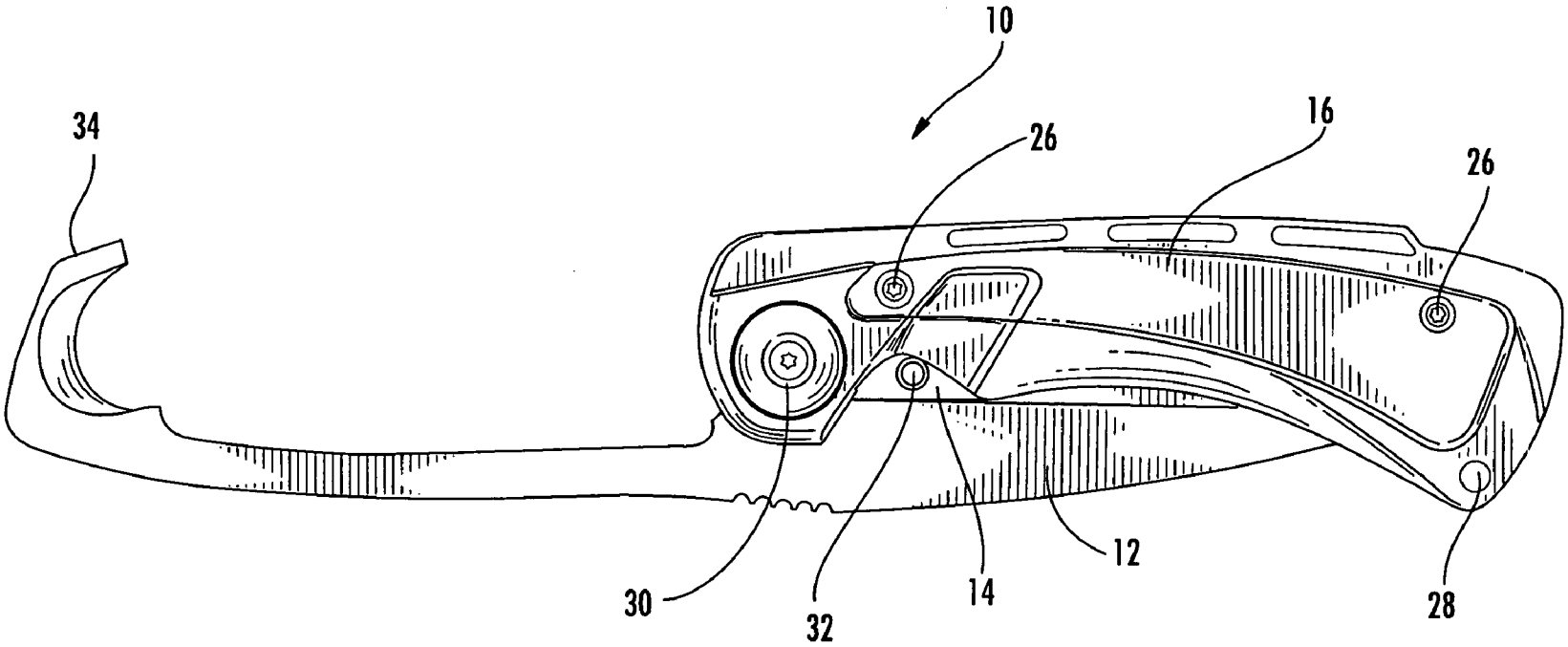
FIG. 7 is perspective view of the hand tool of FIG. 1A in which the locking mechanism is in the third position and the handle has been fully rotated relative to the fixed implement.

As shown in FIG. 7, the portion of the fixed implement 12 that originally extended outwardly from the handle 16 need not be fully received within the interior cavity 20 defined by the handle and a portion can, instead, protrude beyond the handle so as to be grasped by the user. Since the user will grasp that portion of the fixed implement that is proximate to, but protrudes beyond the handle, that portion of the fixed implement is generally designed so as not have any sharp edges or cutting surfaces and to, instead, present a relatively flat or smoothly curved surface that can be comfortably grasped by the user. As described below, the portion of the fixed implement that originally extended outwardly from the handle not only folds at least somewhat into the handle, but can also engage the second implement 14 in a comparable, if not identical, fashion to the manner in which that same portion of the fixed implement and the second implement engaged one another when both were deployed as shown in FIG. 1A.

Accordingly, the hand tool 10 of various embodiments of the invention provides multiple tools with a combination of a rotatable implement 14 and a fixed implement 12. Thus, the versatility of the hand tool is increased, while still providing a fixed implement that is not susceptible of folding upon itself. Accordingly, users, such as hunters, fisherman or the like, can still utilize the fixed implement, such as a fixed knife blade, while also enjoying the additional tools provided by the hand tool which may permit the user to reduce the supplemental tools that otherwise must be carried.

Figure 8:
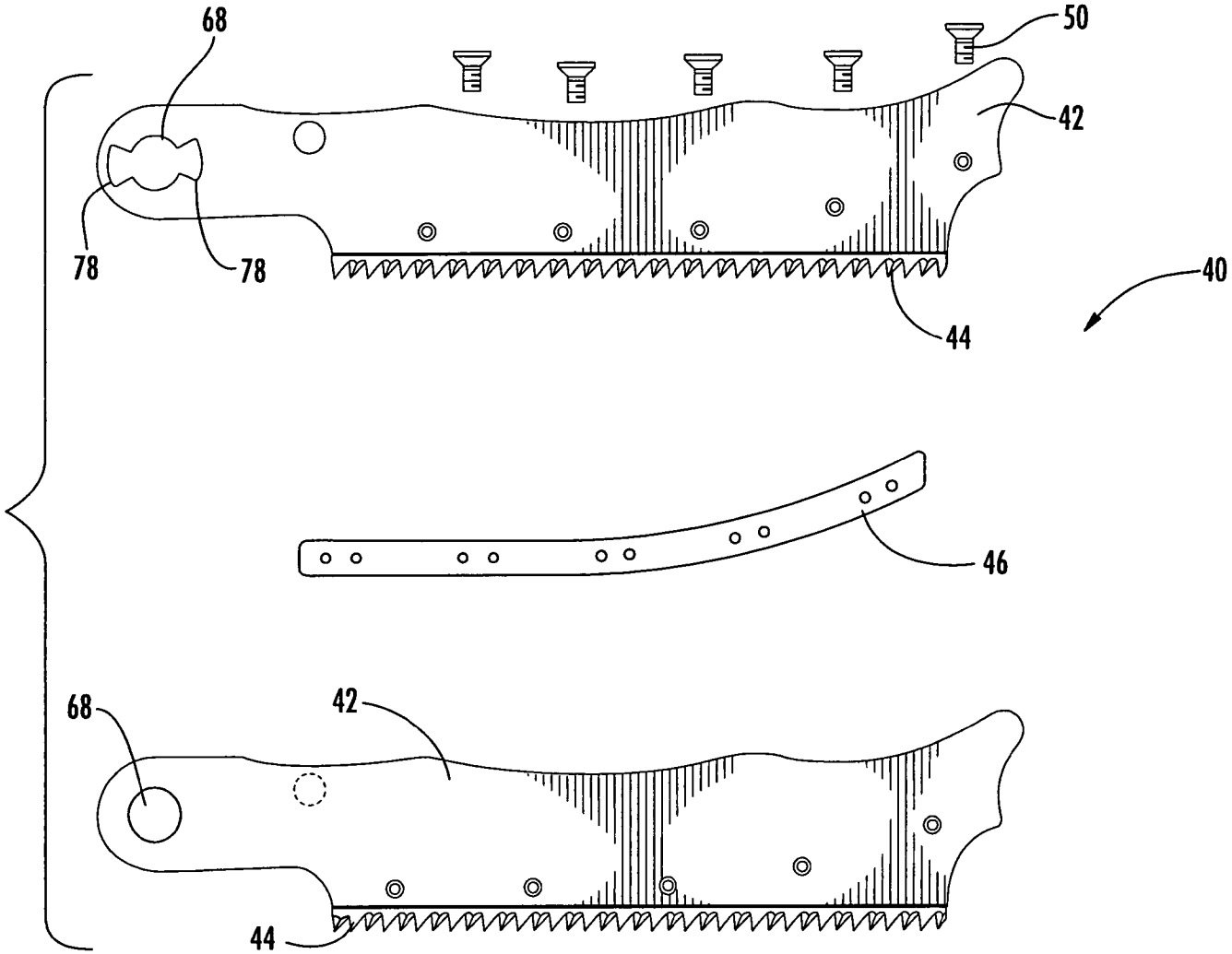
FIG. 8 is an exploded perspective view of a compound tool according to one embodiment of the present invention.

In order to facilitate both the fixed and rotatable implements 12, 14 being deployed at one time and being rotated into the handle 16 at one time, a compound tool 40 is also provided according to one embodiment of the present invention which may function as the second implement of the hand tool 10 described above or may be employed independent of the other features of the hand tool. As shown in FIG. 8, the compound tool includes first and second cutting implements 42, each having a respective cutting edge 44. In one embodiment, each cutting implement is a saw blade having a plurality of saw teeth along respective cutting edges. Alternatively, the first and second cutting implements could be knife blades or the like.

Figure 9:
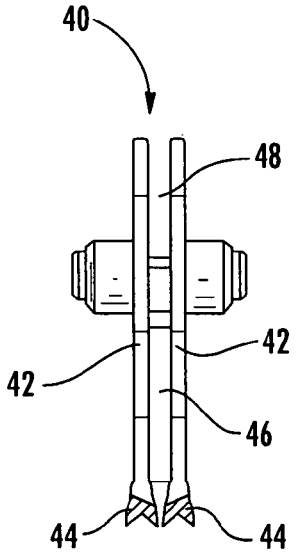
FIG. 9 is an end view of the compound tool of FIG. 8 in an assembled configuration.

The compound tool 40 also includes a spacer 46 positioned between the first and second cutting implements 42 to space the cutting edge of the first cutting implement from the cutting edge of the second cutting implement. Although the spacer generally extends along a majority of the length of the first and second cutting implements, the spacer does not fill the entire space between the first and second cutting implements, but is, instead, positioned proximate the respective cutting edges 44 such that a recess 48 is defined between the cutting implements. See FIG. 9. This recess is generally proximate to and opens between the edges of the cutting implements that are opposite to the respective cutting edges. In the embodiment in which the compound tool is a compound saw, the recess therefore opens between the edges of the saw blades that are opposite the saw teeth. The compound tool also generally includes one or more connecting members 50, such as one or more rivets, screws, adhesive, fasteners or the like, extending between the first and second cutting implements and through the spacer so as to securely interconnect the components of the compound tool.

In embodiments in which the compound tool 40 serves as the rotatable, second implement 14 of a hand tool 10 of the type described above, the compound tool is positioned such that in the first position in which both the fixed and rotatable implements are deployed, a portion of the fixed implement 12 is received by the recess 48 defined by the compound tool. In the embodiment in which the fixed implement includes a knife blade, the cutting edge of the knife blade is received by the recess defined by the compound tool. Thus, the spacer 46 as well as the first and second cutting implements 42 are generally sized and shaped such that the resulting recess approximates but is slightly wider than the portion of the fixed implement that is to be received therein, such as the cutting edge of a knife blade. By permitting a portion of the fixed implement to be nested within the recess defined by rotatable implement, the hand tool of this embodiment permits both implements to be deployed at the same time. Moreover, the positioning of a portion of the fixed implement within the recess defined by the rotatable implement may serve to support the rotatable implement in the deployed position and, in instances in which the fixed implement includes a cutting edge that is positioned with the recess of the rotatable implement, may protect the user or others from inadvertent contact with the cutting edge while the rotatable implement is being used. In this regard, the fixed implement may include a stop 47 against which the rotatable implement abuts.

In the third position of the locking mechanism 30 described above in conjunction with FIG. 7 in which both the rotatable, second implement 14 and the handle 16 have rotated relative to the fixed implement 12, a portion of the fixed implement, such as the cutting edge of a knife blade, may again be received by the recess 48 defined by the rotatable implement. The resulting configuration of the hand tool may thus be more compact and, again, the cutting edge of the knife blade may be tucked away for safety.

Figure 10:
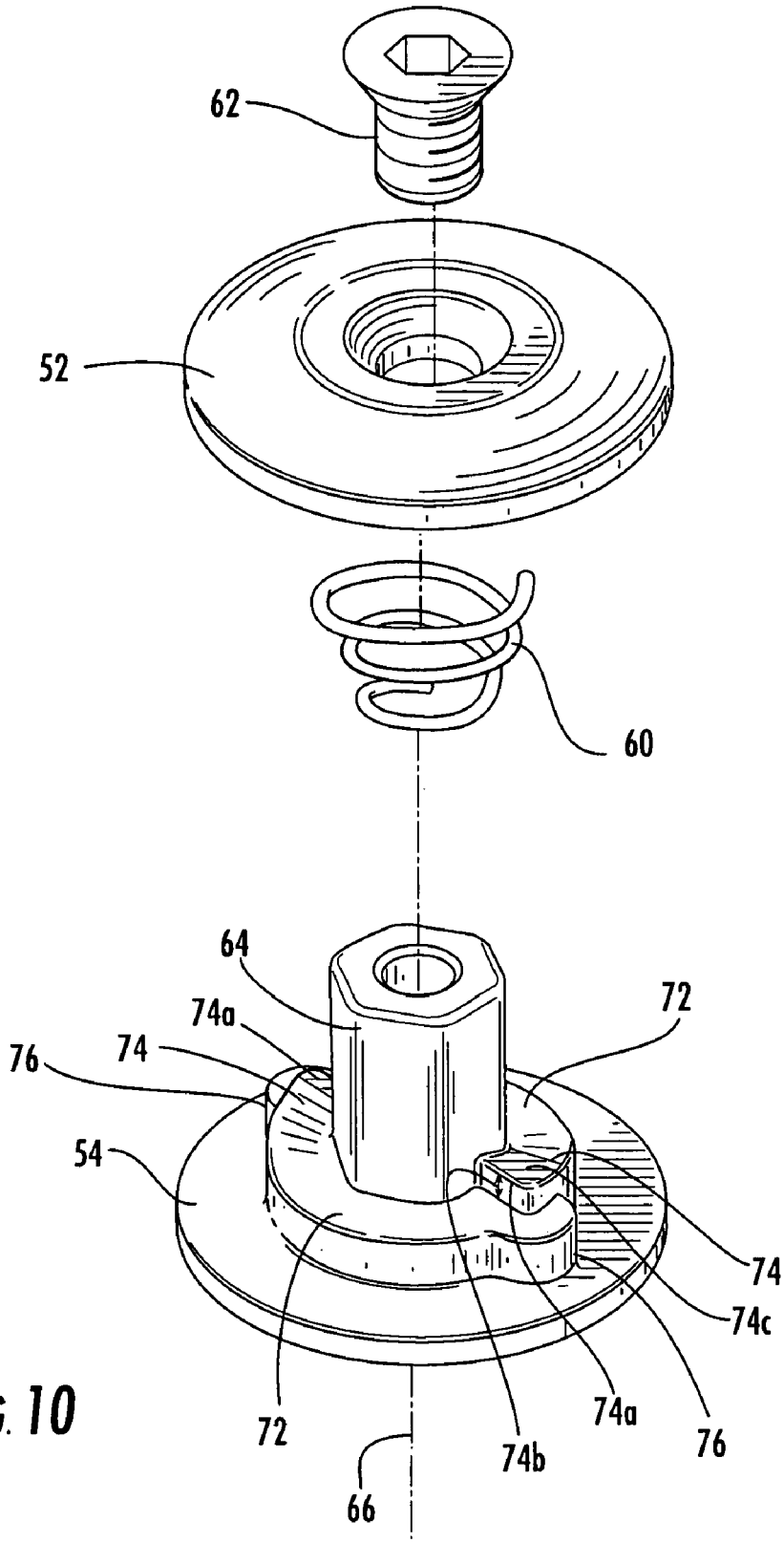
FIG. 10 is an exploded perspective view of a locking mechanism according to one embodiment of the present invention.

Although a variety of locking mechanisms 30 capable of defining the first, second and third positions of the handle 16 and the first and second implements 12, 14 may be employed, a locking mechanism according to one embodiment of the present invention is depicted in more detail in FIG. 10. The locking mechanism of this embodiment includes first and second lock portions 52, 54 (see FIG. 10) that are received by respective apertures 56, 58 (see FIG. 2) defined by the handle. In the embodiment described above in which the handle is formed of first and second handle portions 22, each handle portion may define a aperture for receiving a respective lock portion. The locking mechanism may also include a spring 60 that is disposed between the first lock portion that will be actuated by the user as described below and the first and second implements in order to bias the first lock portion outwardly. Further, the locking mechanism can include a screw 62 or the like for connecting the first and second lock portions.

Figure 11:
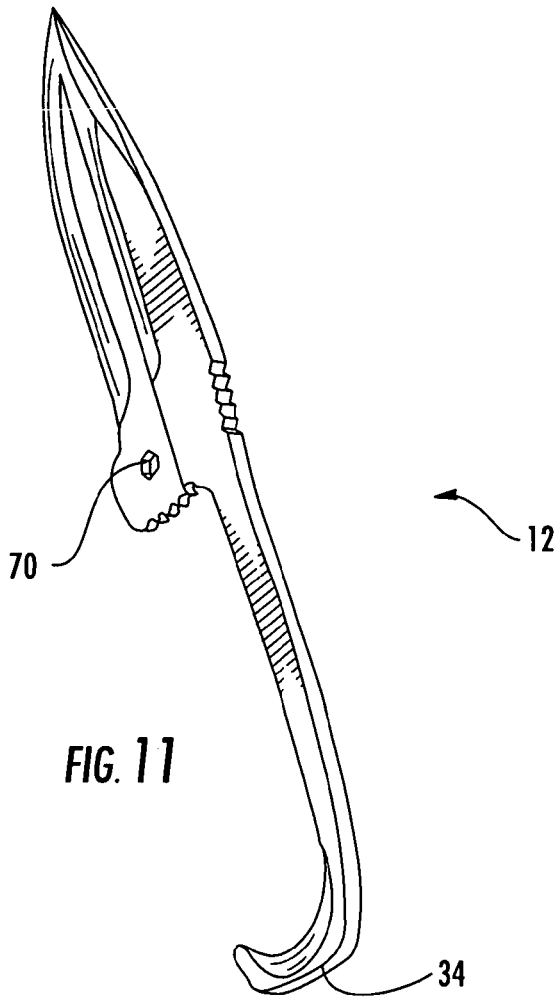
FIG. 11 is a perspective view of a fixed implement of a hand tool according to one embodiment of the present invention.

One or both of the lock portions 52, 54 include a shaft 64 defining a lengthwise extending axis 66. In the illustrated embodiment, for example, the second lock portion includes the lengthwise extending shaft. While the shaft may have various cross-sectional shapes, the shaft may have a polygonal cross-sectional shape as shown in FIG. 10. Both the fixed and rotatable implements 12, 14 define openings through which the shaft extends. As shown in FIG. 8, for example, the opening 68 defined by the rotatable implement is typically slightly larger than the shaft and may have a different shape, such as a circular shape, such that the rotatable implement can rotate relative to the shaft. Conversely, the opening 70 defined by the fixed implement generally has the same shape and size as the shaft so as to be securely mounted upon and restricted in rotation relative to the shaft. See FIG. 11.

The second lock portion 54 includes a support surface 72 extending at least partially and, more typically, entirely about the shaft 64. The support surface includes first and second ramped surfaces 74. Each ramped surface also extends at least partially about the shaft. Typically, each ramped surface extends no more than about 90° and, more typically, no more than about 60° about the shaft. Each ramped surface also has a terminal edge 74*a* that is spaced from an adjacent portion of the support surface by a first axial distance 74*b*. In other words, the terminal edge of each ramped surface is displaced or offset from the adjacent portion of the support surface in the axial direction 66 by the first axial distance.

In the illustrated embodiment, each ramped surface 74 includes a plateau 74*c* proximate the respective terminal edge 74*a* that is parallel to the remainder (i.e., the unramped portion) of the support surface 72. Alternatively, the ramped surfaces can extend continuously at the same or different angles relative to the remainder of the support surface if so desired.

Additionally, the first lock portion 54 includes first and second projections 76 that extend laterally outward from the support surface 72. The first and second projections also have a thickness in the axial direction 66 that differs from the first axial distance 74*b* by which the terminal edge 74*a* of each ramped surface 74 is spaced from the adjacent portion of the support surface. Typically, the thickness of the first and second projections is greater than the first axial distance. As shown, the terminal edges of the first and second ramped surfaces are generally proximate the first and second projections and, more typically, the terminal edges of the first and second ramped surfaces are generally aligned with the first and second projections. In the illustrated embodiment, the terminal edges 74*a* are aligned with a medial portion of the respective projections 76, but can be positioned differently relative to the projections. Additionally, the terminal edges of the first and second ramped surfaces are generally positioned opposite to one another relative to the shaft 64. Likewise, the first and second projections are also typically positioned opposite to one another relative to the shaft.

Figure 12:
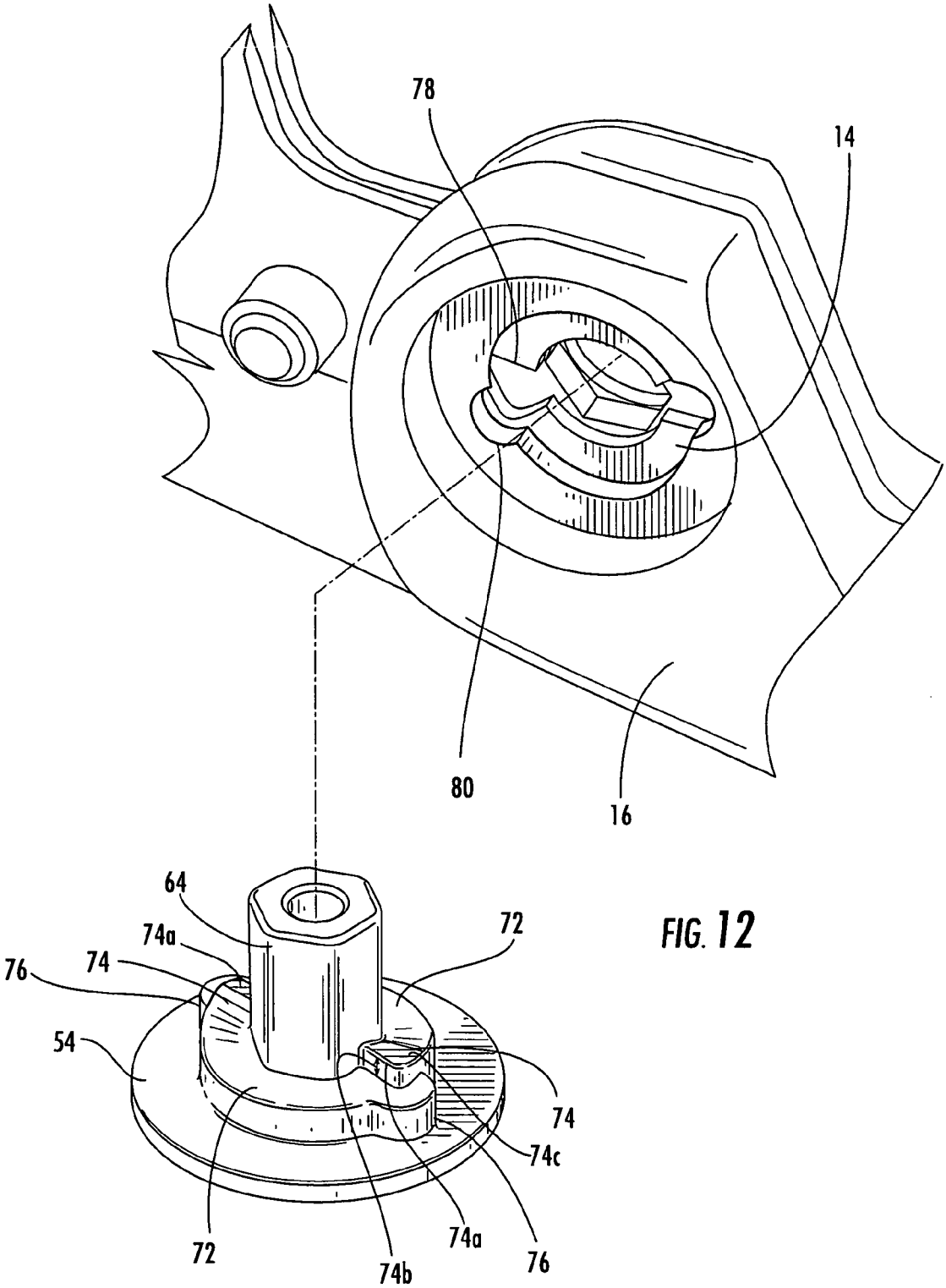
FIG. 12 is an exploded perspective view depicting the insertion of the second lock portion into the remainder of the hand tool according to one embodiment of the present invention.

In order to assemble the hand tool 10 including the locking mechanism 30, those portions of the first and second implements 12, 14 that define the respective openings 70, 68 are positioned within the internal cavity 20 defined by the handle 16 in alignment with the openings 56, 58 defined by the handle portions 22. After positioning the spring 60 between the first lock member 52 and the respective handle portion so as to be in general alignment with the opening 56 defined by the respective handle portion, the first and second lock members are then inserted into the respective openings defined by the handle portions such that the shaft 64 extends through the openings defined by the first and second implements. In this regard, the insertion of the second lock member 54 through the respective openings is depicted in FIG. 12. A screw 62 or the like may then be inserted to connect the first and second lock members and complete the assembly of the locking mechanism.

Figure 13:
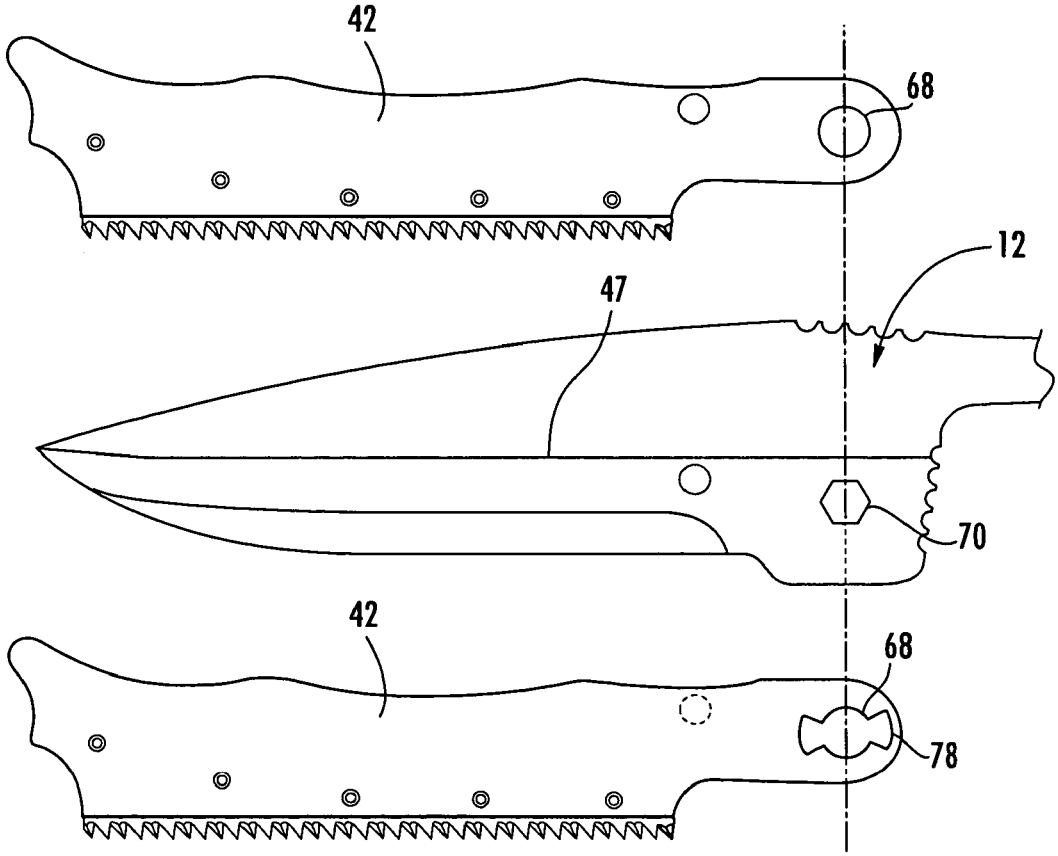
FIG. 13 is an exploded view showing the first and second implements and the openings defined by the respective implements according to one embodiment of the present invention.

In the illustrated embodiment in which fixed and rotatable implements 12, 14 are mounted upon the shaft 64 of the locking mechanism 30, the rotatable implement is a compound tool 40 having first and second cutting implements 42. Each cutting implement defines an opening aligned with the opening defined by the other cutting implement, but spaced thereapart by the spacer 46. Accordingly, the portion of the fixed implement that defines the corresponding opening 70 is positioned between the first and second cutting implements of the rotatable implement as shown schematically in FIG. 13 and the shaft of the locking mechanism is extended therethrough.

Figure 14A:
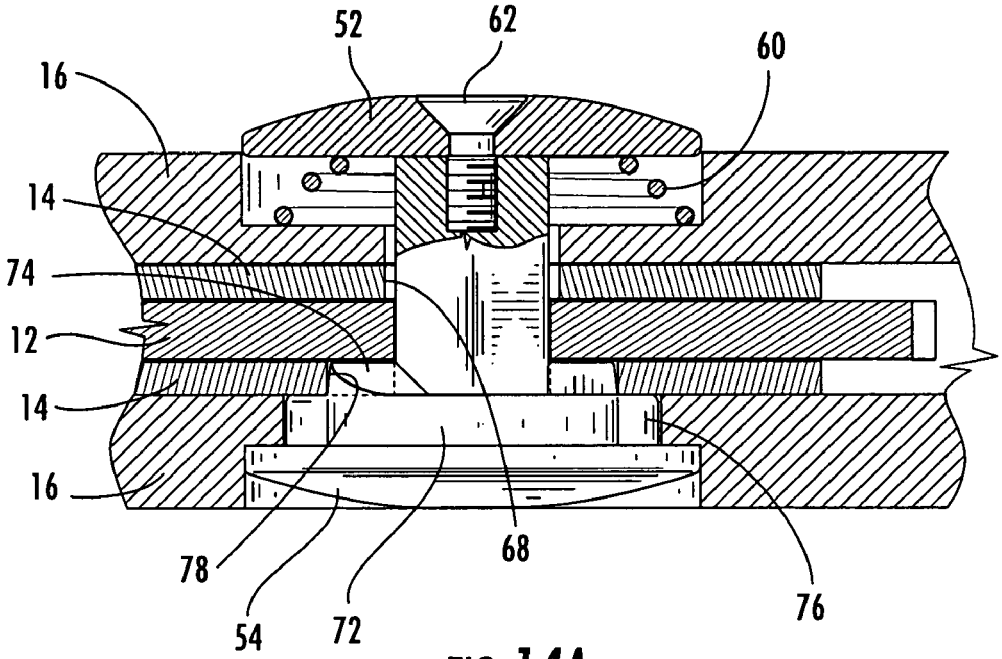
FIGS. 14A and 14B depict the locking mechanism in the first position and the first and second implements in the first position, respectively, according to one embodiment of the present invention.
Figure 14B:
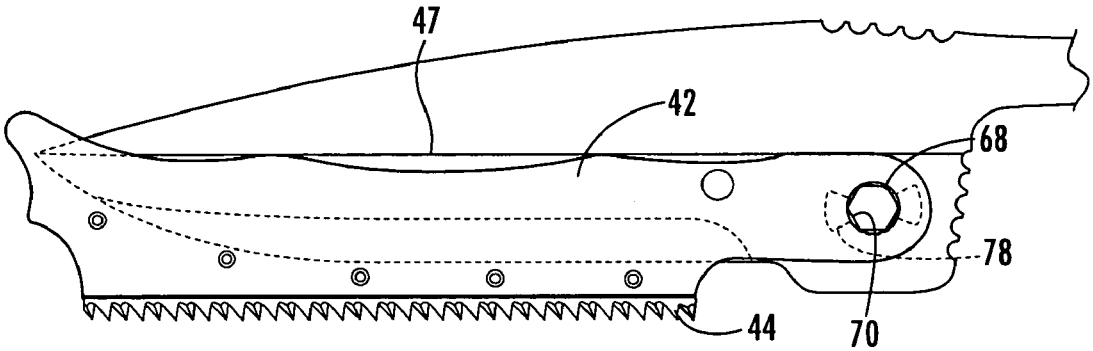

In embodiments in which the second, rotatable implement 14 is a compound tool 40 having two, spaced apart cutting implements 42, the cutting implement that is proximate to and faces the support surface 72 of the second lock portion 54 generally defines first and second lobes 78 extending outwardly from opposite sides of the circular opening 68 described above and depicted in FIG. 8. Each lobe is shaped and sized to receive a respective ramped surface 74 of the support surface such that when the locking mechanism 30 is in the first position, the ramped surfaces are disposed within respective lobes of the opening defined by this cutting implement, as depicted in FIG. 14A. As such, any attempted rotation of the second implement relative to the handle 16 (e.g., in the counterclockwise direction in FIG. 14B) will bring respective edges of the lobes into contact with the axially extending face of the ramped surface proximate the terminal edge 74*a* and prevent such relative rotation. As shown in FIG. 14A, the first and second projections 76 of the second lock portion engage corresponding lobes 80 that are defined by and extend outward from the main opening 58 of the handle 16 such that the handle is also prevented from rotating relative to either implement.

Figure 15A:
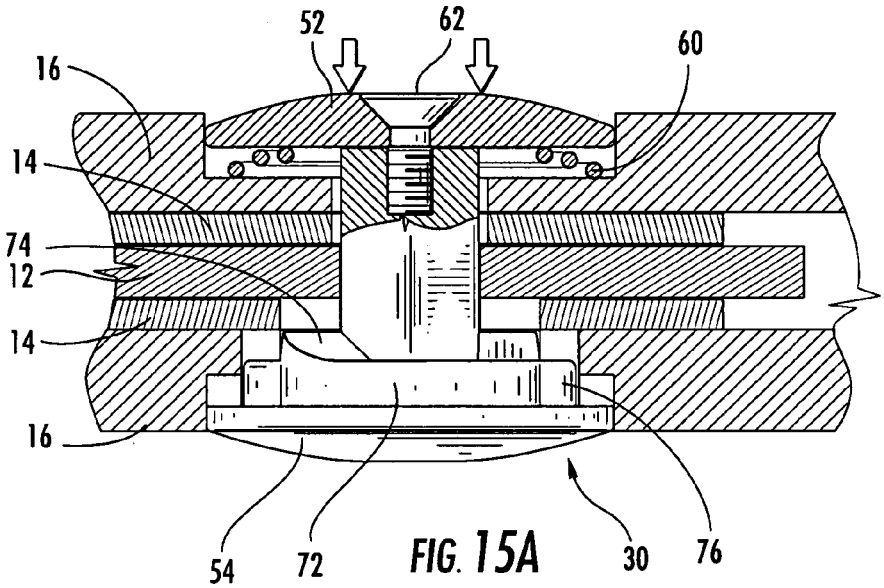
FIGS. 15A and 15B depict the locking mechanism in the second position and the first and second implements in the second position, respectively, according to one embodiment of the present invention.
Figure 15B:
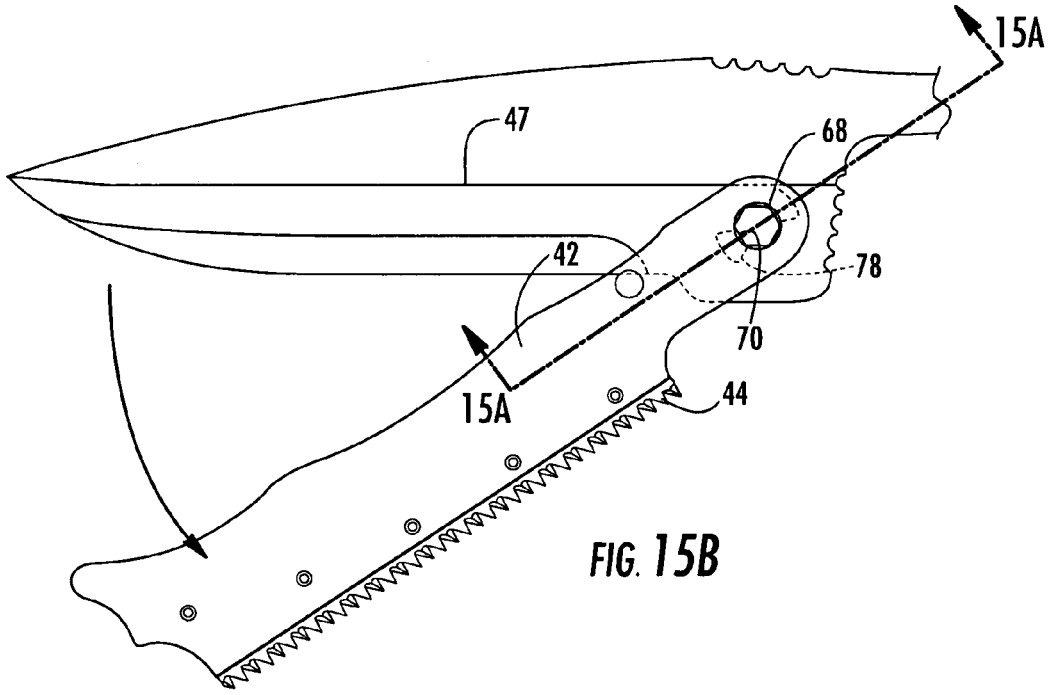

In order to transition from the first position to the second position in which the rotatable member 14 is capable of rotating relative to the fixed implement 12 and the handle 16, a user depresses the first lock portion 52, thereby compressing the spring 60 and displacing the second lock portion 54 such that the ramped surfaces 74 are no longer disposed within and engaged by the lobes 78 of the opening 68 defined by the rotatable implement, as shown in FIG. 15A. As such, the rotatable implement can be rotated relative to the handle and the fixed implement as shown in FIG. 15B. In this regard, once the ramped surfaces have been disengaged from the lobes of the opening defined by the rotatable implement, the rotatable implement is capable of rotating about the shaft 64 since the opening defined by the rotatable implement (including the openings defined by both the first and second cutting implements 42 in embodiments in which the rotatable implement is a compound tool 40) is at least slightly larger than the shaft.

During the relative rotation of the rotatable implement 14 with respect to the handle 16, the fixed implement 12 and the locking mechanism 30, the rotatable implement of one embodiment rides upon and is supported by the ramped surfaces 74. See FIG. 15A. Alternatively, the rotatable implement may be spaced from the ramped surfaces during the relative rotation. In the illustrated embodiment, once the rotatable implement has rotated by 180° and is now disposed within the internal cavity 20 defined by the handle, the ramped surfaces 74 again engage respective lobes 78 of the opening 68 defined by the rotatable implement. However, the rotatable implement can be more easily rotated in the reverse direction since the rotation of the rotatable implement in the reverse direction will only require the rotatable implement to gradually ride up the ramped surface, thereby biasing the rotatable implement against movement from the folded to the open or deployed position, but not preventing such movement.

During rotation of the rotatable implement 14 relative to the handle 16 and the first implement 12 while the locking mechanism 30 is in the second position, the handle and the first implement are restrained from relative rotation with respect to the locking mechanism with the handle being restrained by the continued engagement of the first and second projections 76 of the second lock portion 54 with corresponding lobes 80 of the opening 58 defined by the handle as shown in FIG. 15A and with the fixed implement being restrained the correspondence between the opening 70 defined by the fixed implement and the shaft 64 which serves to prevent any meaningful rotation of the fixed implement relative to the shaft.

Figure 16A:
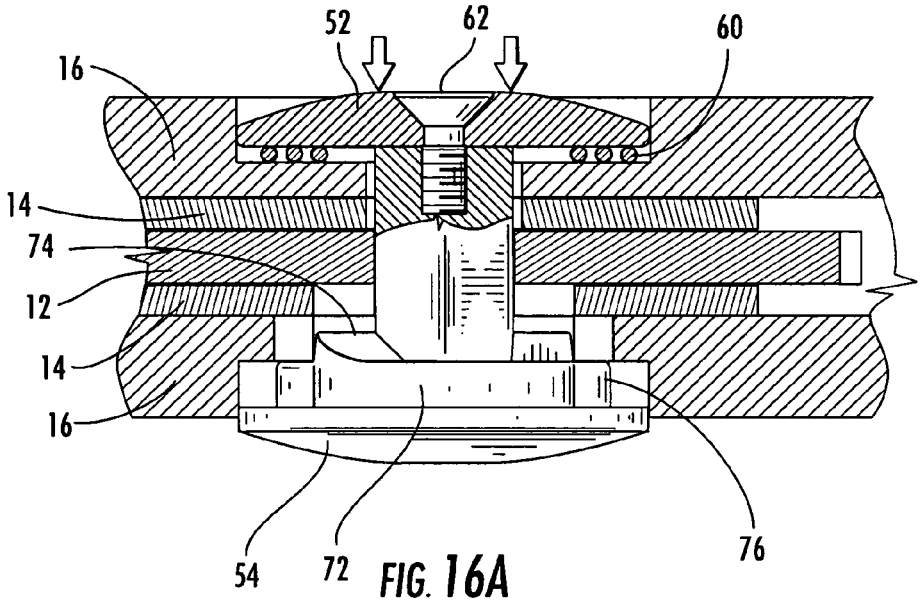
FIGS. 16A and 16B depict the locking mechanism in the third position and the first and second implements in the third position, respectively, according to one embodiment of the present invention.
Figure 16B:
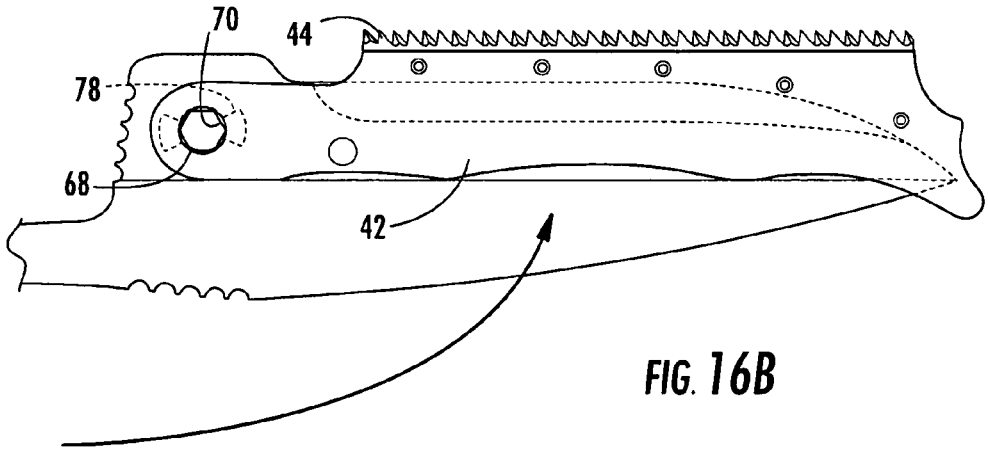

To transition the locking mechanism 30 into the third position, the user again depresses the first lock portion 52, albeit more greatly than is required for the transition from the first position to the second position. In this regard, the user depresses the first lock portion to such a degree that the first and second projections 76 disengage from corresponding lobes 80 of the opening 58 defined by the handle 16 as shown in FIG. 16A and the handle is then capable of being rotated relative to the locking mechanism and relative to the fixed and rotatable implements 12, 14 to the position shown in FIG. 16B.

As such, the locking mechanism 30 of this embodiment controllably provides first, second and third positions for the handle 16 and the fixed and rotatable implements 12, 14 such that each of the tools provided by the fixed and rotatable implements can be individually deployed and utilized by the user in a relatively straightforward and intuitive manner.

Figure 17:
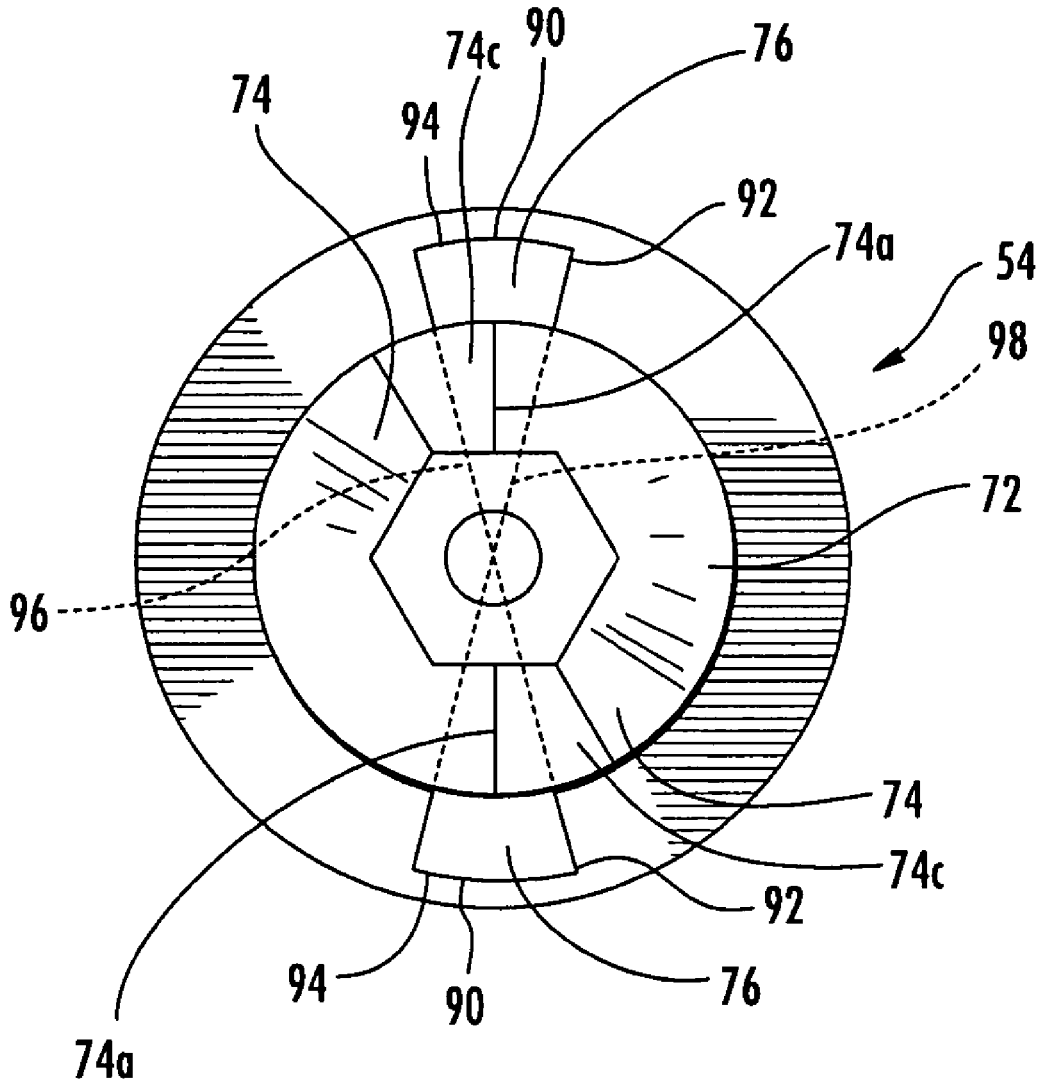
FIG. 17 depicts the second lock portion of a locking mechanism according to another embodiment of the present invention.

The second lock portion 54 of a locking mechanism 30 of an alternative embodiment is depicted in FIG. 17. The second lock portion of this embodiment is identical to that shown in FIG. 10 and described above with the exception of the first and second projections 76. In this regard, the first and second projections are configured such that those portions of the first and second projections that contact the edge of the opening 58, i.e., the handle, and prevent relative rotation between the handle and the locking mechanism are symmetric relative to a center of gravity of the locking mechanism. As shown, each of the first and second projections may include a distal portion 90 that extends between first and second corners 92, 94. In this embodiment, an imaginary line 96 extending from the first corner of the first projection to the second corner of the second projection extends through the center of gravity of the locking mechanism, while an imaginary line 98 extending from the second corner of the first projection to the first corner of the second projection also extends through the center of gravity of a locking mechanism. As such, a locking mechanism having the first and second projections of this embodiment may experience reduced torsional stresses during actuation than other, non-symmetric designs in which those portions of the first and second projections that contact the edge of the opening defined by the handle and prevent relative rotation between the handle and the locking mechanism are not symmetric relative to the center of gravity of the locking mechanism.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A hand tool comprising:

a handle;

first and second implements rotatably connected to said handle; and a locking mechanism extending axially through respective openings defined by the handle and the first and second implements, wherein said locking mechanism is configured to move axially relative to the handle and the first and second implements to define first, second and third positions, wherein said locking mechanism in the first position locks said handle and said first and second implements to thereby prevent relative rotation therebetween, wherein said locking mechanism in the second position permits relative rotation between said second implement and said handle while preventing relative rotation between said first implement and said handle, and wherein said locking mechanism in the third position permits relative rotation between said handle and said first implement.

2. A hand tool according to claim 1 wherein said locking mechanism in the third position also permits relative rotation between said second implement and said handle.

3. A hand tool according to claim 1 wherein said locking mechanism comprises:

a shaft defining a lengthwise extending axis;

a support surface extending at least partially about said shaft, said support surface comprising at least one ramped surface that extends both at least partially about said shaft and axially along said shaft; and at least one projection that extends laterally outward from said support surface.

4. A hand tool according to claim 3 wherein said first and second implements are mounted upon said shaft, wherein said second implement defines an opening that receives the at least one ramped surface while said locking mechanism is in the first position, and wherein the at least one ramped surface is displaced from the opening defined by said second implement in the second position.

5. A hand tool according to claim 3 wherein said first and second implements are mounted upon said shaft, wherein said handle defines an opening that receives said at least one projection while said locking mechanism is in the first and second positions, and wherein said at least one projection is displaced from the opening defined by said handle while said locking mechanism is in the third position.

6. A hand tool according to claim 3 wherein said at least one projection comprises first and second projections positioned symmetrically relative to a center of gravity of said locking mechanism.

7. A hand tool according to claim 6 wherein each of said first and second projections includes a distal portion that extends between first and second corners, wherein an imaginary line extending from the first corner of said first projection to the second corner of said second projection extends through the center of gravity of said locking mechanism, and wherein an imaginary line extending from the second corner of said first projection to the first corner of said second projection extends through the center of gravity of said locking mechanism.

8. A hand tool according to claim 3 wherein said shaft has a polygonal cross-sectional shape.

9. A hand tool comprising:

a handle;

a first implement extending outwardly from said handle; and a second implement configured to rotate relative to said handle between a deployed position and a closed position, wherein one of said first and second implements defines a recess therein such that at least a portion of the other implement is disposed within the recess when said second implement is disposed in the deployed position.

10. A hand tool according to claim 9 wherein said second implement defines the recess.

11. A hand tool according to claim 10 wherein said first implement comprises a knife blade having a cutting edge, and wherein the cuffing edge of said knife blade is disposed within the recess defined by said second implement when said second implement is disposed in the deployed position.

12. A hand tool according to claim 11 wherein said first implement comprises a fixed blade extending from a first end proximate the knife blade to an opposed tang disposed within said handle while said knife blade extends outwardly from said handle.

13. A hand tool according to claim 12 wherein said first implement further comprises a gut hook proximate the tang.

14. A hand tool according to claim 10 wherein said second implement comprises a saw.

15. A hand tool according to claim 14 wherein said saw comprises a plurality of saw teeth extending along a first edge, and wherein the recess defined by said saw opens through a portion of said saw opposite the first edge.

16. A hand tool according to claim 14 wherein said saw comprises:

first and second saw blades; and a spacer positioned between said first and second saw blades to thereby space said first and second saw blades apart from one another, thereby defining the recess between said first and second saw blades.

17. A hand tool according to claim 9 further comprising a locking mechanism for locking said handle and said second implement when said second implement is disposed in the deployed position.

18. A compound tool comprising:

first and second cutting implements, each cutting implement having a respective cutting edge; and a spacer positioned between said first and second cutting implements to thereby space the cutting edge of said first cutting implement from the cutting edge of said second cutting implement, wherein said first and second cutting implements and said spacer are operably connected to one another such that the first and second cutting implements are configured for movement in unison with one another.

19. A compound tool according to claim 18 wherein said first and second cutting implements comprise first and second saw blades, each saw blade comprising a plurality of saw teeth along the respective cutting edge, and wherein said spacer is positioned between said first and second saw blades to thereby space the plurality of saw teeth of said first saw blade from the plurality of saw teeth of said second saw blade.

20. A compound tool according to claim 18 wherein a recess is defined that opens between respective edges of said first and second cutting implements that are disposed opposite to the cutting edges.

21. A compound tool according to claim 20 wherein said spacer is disposed closer to the cutting edges of said first and second cutting implements than the respective edges of said first and second cutting implements that are disposed opposite to the cutting edges.

22. A compound tool according to claim 18 further comprising at least one connecting member for interconnecting said first and second cutting implements and said spacer.

23. A locking mechanism comprising:

a shaft defining a lengthwise extending axis;

a support surface extending at least partially about said shaft, said support surface comprising at least one ramped surface that extends both at least partially about said shaft in a circumferential direction and axially along said shaft, wherein each ramped surface has a terminal edge that is axially spaced from an adjacent portion of said support surface by a first axial distance; and a plurality of projections spaced apart from one another about the support surface, each projection extending laterally outward from said support surface, wherein each projection has a thickness in an axial direction that differs from the first axial distance, wherein the terminal edge of at least one ramped surface is proximate a respective projection, and wherein the terminal edge of the at least one ramped surface and the respective projection overlap in the circumferential direction such that portions of the respective projection extend in opposite circumferential directions from the terminal edge of the at least one ramped surface.

24. A locking mechanism according to claim 23 wherein the thickness of each projection is greater than the first axial distance by which the terminal edge of each ramped surface is axially spaced from adjacent portions of said support surface.

25. A locking mechanism according to claim 23 wherein said at least one ramped surface comprises first and second ramped surfaces, and wherein the terminal edges of the first and second ramped surfaces are positioned opposite to one another relative to said shaft.

26. A locking mechanism according to claim 23 wherein each ramped surface extends no more than 90° about said shaft.

27. A locking mechanism according to claim 23 wherein said at least one projection comprises first and second projections, and wherein said first and second projections are positioned symmetrically relative to a center of gravity of the locking mechanism.

28. A locking mechanism according to claim 27 wherein each of said first and second projections includes a distal portion that extends between first and second corners, wherein an imaginary line extending from the first corner of said first projection to the second corner of said second projection extends through the center of gravity of the locking mechanism, and wherein an imaginary line extending from the second corner of said first projection to the first corner of said second projection extends through the center of gravity of the locking mechanism.

29. A locking mechanism according to claim 23 wherein said shaft has a polygonal cross-sectional shape.

30. A locking mechanism according to claim 23 wherein the terminal edge of the at least one ramped surface is proximate a medial portion of the respective projection in the circumferential direction.

* * * * *

UNITED STATES PATENT AND TRADEMARK OFFICE

CERTIFICATE OF CORRECTION

PATENT NO. : 7,654,004 B2
APPLICATION NO. : 11/410439
DATED : February 2, 2010
INVENTOR(S) : Hollan Akio Tsuda It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 119 days.

Signed and Sealed this

Twenty-third Day of November, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,654,004 B2
APPLICATION NO. : 11/410439
DATED : February 2, 2010
INVENTOR(S) : Tsuda It is certified that error appears in the above-identified patent and that said Letters Patent is hereby corrected as shown below:

Column 14,

Line 22, "cuffing" should read --cutting--.

Signed and Sealed this
Twenty-first Day of June, 2011

David J. Kappos

David J. Kappos
*Director of the United States Patent and Trademark Office*